US005369233A

United States Patent [19]

Gallone

[11] Patent Number: 5,369,233

[45] Date of Patent: Nov. 29, 1994

[54] SAFETY PRESSURE SENSOR, IN PARTICULAR FOR MICROSWITCHES

[76] Inventor: Cesare Gallone, Via Milano 27, Cornaredo (MI), Italy

[21] Appl. No.: 88,195

[22] Filed: Jul. 6, 1993

[30] Foreign Application Priority Data

Jul. 24, 1992 [IT] Italy ..... MI92 U 000055

[51] Int. Cl.[5] ..... H01H 35/34

[52] U.S. Cl. ..... 200/83 J; 73/723; 200/306

[58] Field of Search ..... 200/83 R, 83 B, 83 W, 200/82 C, 83 J, 306; 307/118; 340/626; 73/717, 723, 861.47

[56] References Cited

U.S. PATENT DOCUMENTS 4,225,760 9/1980 Griffith ..... 200/83 J
4,900,883 2/1990 Brame ..... 200/83 J

FOREIGN PATENT DOCUMENTS 1250613 7/1983 France ..... 200/83 J
687531 3/1965 Italy ..... 200/83 J
430448 11/1974 U.S.S.R. ..... 200/83 J

*Primary Examiner*—Gerald P. Tolin
*Attorney, Agent, or Firm*—Kolisch, Hartwell, Dickinson, McCormack & Heuser

[57] ABSTRACT

A safety pressure sensor in particular for microswitches comprises a base body (2) to be engaged to a receptable containing a fluid under pressure, a flexible diaphragm (6) disposed in contact with the fluid under pressure and acting on a microswitch (9) connected to the pressure sensor (1 ), a protective cap (5) adapted to accommodate the flexible diaphragm (6) and actuating means (10) adapted to transmit the diaphragm thrust to the microswitch (9) through the protective cap (5).

3 Claims, 2 Drawing Sheets

SAFETY PRESSURE SENSOR, IN PARTICULAR FOR MICROSWITCHES

The present invention relates to a safety pressure sensor, in particular for microswitches, of the type comprising a base body which is at least partly hollow, to be engaged to a receptable containing fluid under pressure, and a flexible diaphragm engaged to said base body and disposed in contact with said fluid under pressure, said flexible diaphragm acting on a microswitch connected to the pressure sensor itself.

In greater detail, the pressure sensor in question can find application in many appliances such as for example vacuum cleaners and liquid-aspirating apparatus, carpet and fitted carpet washing apparatus, boilers and the like, where the fluid in contact with the flexible diaphragm consists of low- and medium-pressure water, for example.

It is known that pressure sensors are devices responsive to variations in the pressure of both liquid and gaseous fluids generally used for controlling power members of the electric type, motors for example, or transmitting control signals.

Pressure sensors of the known type are currently comprised of a base body. which is at least partly hollow, to be engaged to a receptable containing fluid under pressure and an actuator, a flexible diaphragm for example, engaged to the base body itself so as to close it, and disposed in contact with the fluid under pressure. The diaphragm, upon achievement of a predetermined pressure threshold of the fluid, bends and acts on an electric switch, usually a microswitch, connected to the pressure sensor itself.

In greater detail, in a known type of pressure sensor it is provided that the base body should be closed at the upper part thereof by a box-shaped envelope defining at the inside thereof a cavity containing the metal diaphragm, the microswitch contacts, and a rod disposed operatively between the diaphragm and the contacts. The diaphragm, by its deformation, causes the axial movement of the rod that, by selectively operating the microswitch, causes an electric circuit to be opened or closed.

For the purpose of preventing the liquid under pressure from impinging on the electric contacts thereby causing short circuits, provision is made for a particularly strong flexibile diaphragm. To this end the diaphragm is generally made of a metal material.

In conclusion, the safety in operation of the above described pressure sensors exclusively relies on the strength and durability features of the flexible diaphragm provided therein. Due to the fact that said diaphragm is subjected not only to possible attacks of the corrosive type from the liquid with which it is in contact, but also to fatigue stresses as a result of the great number of flexions in the two ways to which it is cyclically submitted, a sudden yielding of the diaphragm is likely to occur above all in the case of pressure sensors in operation for long periods of time, which results in the projection of the liquid onto the contacts of the adjacent microswitch. It is clearly understood that this circumstance inevitably gives rise to short circuits which represent further risks for the user.

In another pressure sensor of the known type, the microswitch is contained in a corresponding box-shaped enclosure made of plastic material connected to the base body so as to exhibit a lower closing wall facing the diaphragm. A pin set into motion by the diaphragm deformation is constrained to slide axially within a guide hole formed through the lower wall of the box-shaped enclosure and selectively operates the microswitch. In this case even if the microswitch is physically separated from the diaphragm, should a failure occur in the diaphragm seal, the liquid under pressure could only escape to the inside of the box-shaped enclosure containing the microswitch.

Therefore in this case too the same problems as with the previously described pressure sensor exist.

In another pressure sensor of known type the microswitch is contained in a box-shaped enclosure fastened above the base body by means of a support body. Defined within the support body and on the upper part with respect to the diaphragm is a cavity in communication with the surrounding atmosphere through one or more openings. While these openings enable the liquid to escape therethrough should the diaphragm lose its seal capability, they do not offer any ensurance about the liquid reaching the microswitch contacts.

In effect, the microswitch directly faces the diaphragm and is at all events exposed to the liquid which is ejected from the base body chamber, in case of breakage of the diaphragm.

Practically this construction solution can offer a certain degree of safety only if the pressure sensor is conceived and used for detecting very low pressure values, not higher than some hundredths of bar.

Under this situation, the general aim of the present invention is to devise a safety pressure sensor capable of substantially elimination the above drawbacks.

Within the scope of this general aim it is an important object of the present invention to devise a safety pressure sensor capable of preventing electric parts of the microswitch to which the pressure sensor is connected from being accidentally brought into contact with liquids under pressure, even in case of breakage of the diaphragm actuator provided in the pressure sensor.

The above object is substantially attained by a safety pressure sensor in particular for microswitches, characterized in that it comprises a protective cap adapted to accommodate said flexible diaphragm engaged to said base body, and actuating means for said microswitch adapted to transmit the thrust exerted on said diaphragm to the microswitch itself through said protective cap.

The description of a preferred embodiment of a safety pressure sensor in accordance with the invention is now given with the aid of the accompanying drawings, in which.

Figure 1:
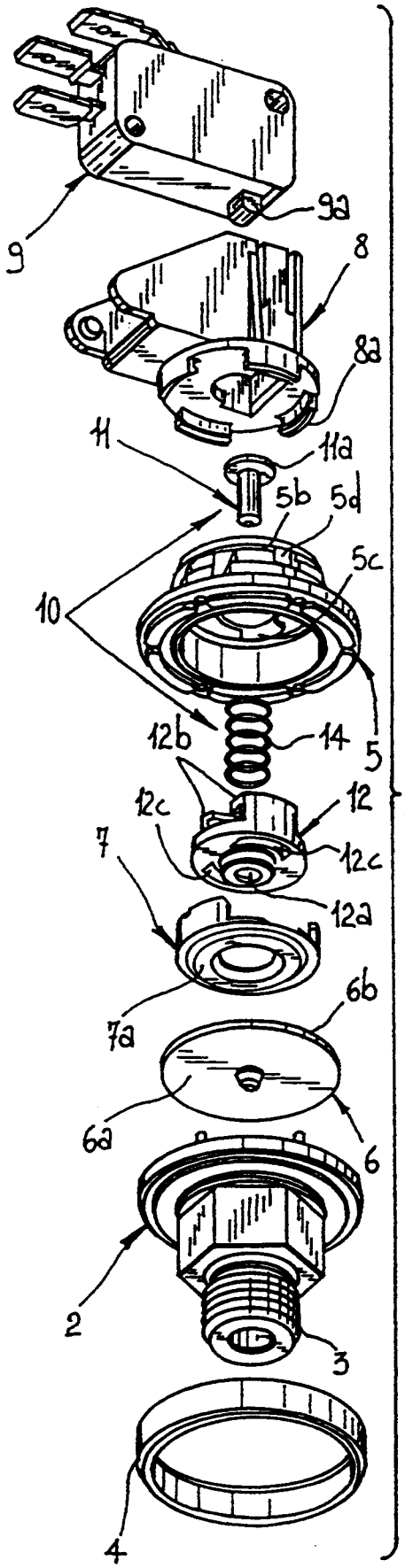
FIG. 1 is an exploded perspective view of a pressure sensor in accordance with the invention.
Figure 2:
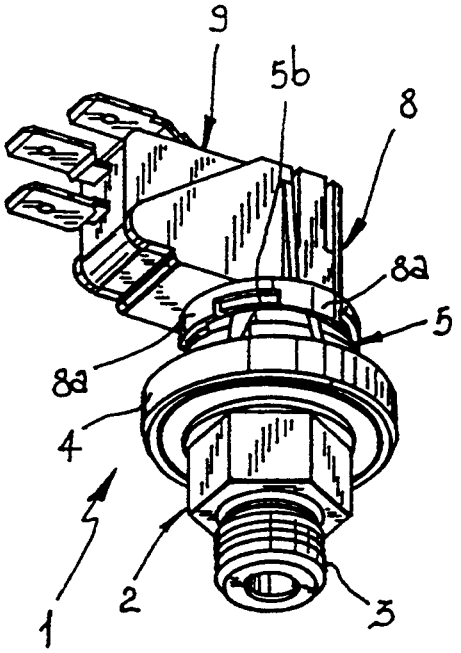
FIG. 2 is a perspective view of the pressure sensor in an assembled condition.
Figure 3:
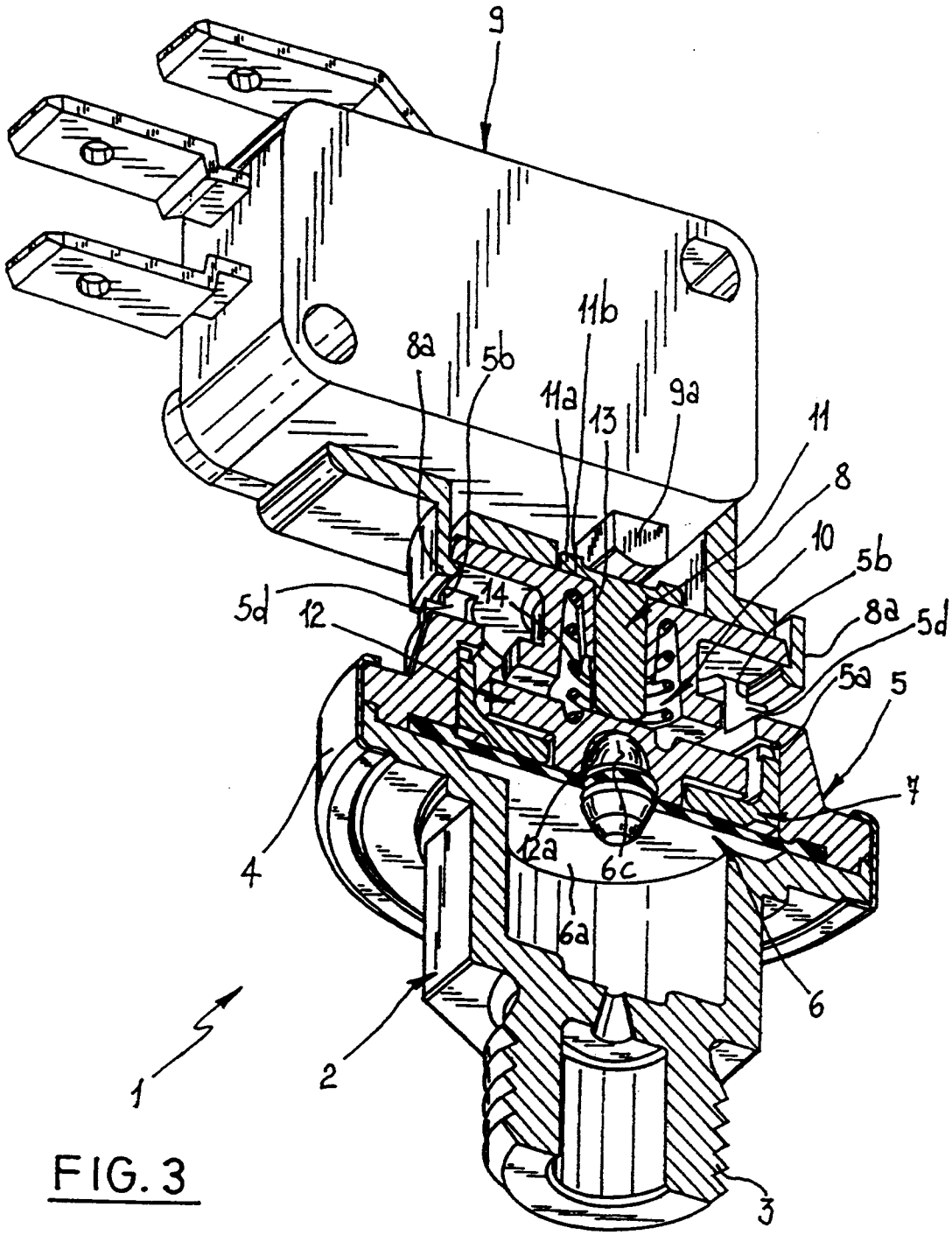
FIG. 3 is a longitudinal sectional view in perspective of the pressure sensor shown in FIG. 2.

Referring to the drawings, the safety pressure sensor in accordance with the invention is generally identified by reference numeral 1.

It comprises a base body 2 which is partly hollow and is provided with a threaded end portion 3 for engagement to a receptable containing a fluid under pressure, specifically a liquid under pressure.

Engaged to the base body 2 by means of a fastening ring 4, at an opposite position to the end portion 3, is a protective cap 5. Within the cap 5 there is a flexible diaphragm 6 closing the base body 2. The diaphragm 6 has one face 6a in contact with the fluid under pressure contained in the base body 2 and a second opposite face 6b partially in contact with a support element 7 at an annulus-shaped region thereof 7a. The support element 7 is fitted in the cap 5 against an abutment 5a and carries out the stiffening of the diaphragm 6 thereby reducing the flexional oscillations to which its face 6a is subjected as a result of pressure variations.

An attachment body 8 of a microswitch 9 is mounted on cap 5, on the opposite side of the cap from the side of the coupling base body 2. The attachment body 8 is circumferentially provided with a plurality of curved teeth 8a fitted in a circular groove 5b formed in the end portion of the cap 5. In this manner the attachment body 8 and therefore the microswitch 9 are rotatably engaged relative to the cap 5 and the base body 2. This situation greatly facilitates the screwing operation of the base body 2 to the receptable on which the pressure sensor 1 is mounted. In addition, the relative-rotation capability between the attachment body 8 and cap 5 enables the microswitch 9 to be oriented according to the desired angle in relation to the required assembling arrangement.

Provided between the microswitch 9 and the flexible diaphragm 6 is means 10 for actuating the microswitch 9; said means is adapted to transmit the diaphragm thrust through the cap 5.

In greater detail, the actuating means 10 comprises a cylindrical pusher 11 and an actuating disc 12 interposed between the diaphragm 6 and the cylindrical pusher 11. The pusher 11 is movable within a through hole 13 formed in the cap 5 the shape of which exactly matches that of the cylindrical pusher 11 so that coupling between the two pieces affords a very reduced play.

The cylindrical pusher 11 at one end thereof has a head 11a designed to be in contact with a movable portion or switching member 9a of the microswitch 9 and acting in front abutment, substantially in sealing relationship, on a support surface 11b exhibited by the upper part of the cap 5.

The actuating disc 12 as a central hollow 12a receiving a diaphragm projection 6c and is held against the diaphragm by effect of a spring pressure element 14 consisting of a spring for example, located inside the cap 5.

In addition the actuating disc 12 is provided with a pair of curved hooking elements 12b, to be coupled with respective curved attachments 5c provided in the cap 5 and adapted to retain the actuating disc 12 on mounting, while at the same time enabling it to slide in the axial direction of the cylindrical pusher 11 against the action of the spring element 14.

Advantageously the actuating disc 12 has through slits 12c, and side discharge openings 5d are provided in the protective cap 5. The through slits 12c and discharge openings 5d perform the function of safety vents that, should the diaphragm 6 break, would enable the fluid consequently admitted to the cap 5 to be discharged to the outside of the cap itself guiding it away from the microswitch 9.

The presence of the above mentioned safety vents avoids leakages even of very reduced amount taking place between the cylindrical pusher 11 and the hole 13 in which said pusher is fitted. In fact the fluid and in particular the liquid under pressure that should accidentally enter the cap 5 would immediately find an outlet to the outside through said discharge openings 5d.

Fluid leakages to the microswitch 9 are further hindered by the sealing action exerted by the pusher head 11a on the support surface 11b.

At all events, should small amounts of liquid escape and pass the pusher 11, they could never reach the inner component elements of the microswitch 9, taking also into account the fact that said microswitch, as is known, is located in the upper part of the pressure sensor.

The present invention attains the intended purposes.

The pressure sensor in question is in fact capable of completely eliminating undesirable contacts between the liquid under pressure and the inner microswitch component elements, even in case of a sudden yielding of the diaphragm 6 in the presence of rather high pressures.

As compared to the known art, this result represents an important progress in the safety field, in that any risks of short circuits are completely eliminated and, as a result, dangers for a person using the apparatus on which the pressure sensor is mounted no longer exist.

All of the details may be replaced by technically equivalent elements and in practice the materials used and the sizes may be of any nature and magnitude depending on requirements.

I claim:

1. In a safety pressure sensor and microswitch combination which includes a base body which is at least partly hollow adapted to be connected to a receptacle containing fluid under pressure, a switching member for the microswitch, and a flexible diaphragm mounted on said base body exposed to said fluid under pressure and acting on the switching member, the improvement comprising:

a protective cap covering said flexible diaphragm mounted on said base body, and actuating means for the microswitch adapted to transmit movement of the diaphragm to the switching member, said actuating means comprising a pusher extending through said protective cap and the pusher having one end contacting the switching member and an opposite end, an actuating disc interposed between said opposite end of the pusher and said diaphragm, and a spring located within the cap constructed to urge said actuating disc against the diaphragm, said actuating disc having a slit therein and said cap having a discharge opening therein facing away from said switching member and said slit and discharge opening communicating with each other and providing a path for the escape of fluid that may collect within the cap.

2. The safety pressure sensor and microswitch combination of claim 1 which further includes an attachment body secured to and supporting the microswitch, and said attachment body is secured to the cap by means relatively rotatably engaging the outside of the cap.

3. In a safety pressure sensor and microswitch combination which includes a base body which is at least partly hollow, adapted to be connected to a receptacle containing fluid under pressure, a switching member for the microswitch, and a flexible diaphragm mounted on said base body exposed to fluid under pressure and acting on the switching member, the improvement comprising:

a protective cap covering said flexible diaphragm mounted on said base body, actuating means for the microswitch adapted to transmit movement of the diaphragm to the switching member and said actuating means including a pusher extending through the cap with one end engaging the switching member and an opposite end operated on by said diaphragm, an attachment body secured to and supporting the microswitch, and relatively rotatable means detachably connecting said attachment body to said cap, the relatively rotatable means comprising a plurality of circumferentially distributed curved teeth on the attachment body and a groove extending about the periphery of the cap, said teeth engaging said groove.

* * * * *